US008602213B2

(12) United States Patent
Lowery et al.

(10) Patent No.: US 8,602,213 B2
(45) Date of Patent: Dec. 10, 2013

(54) PRODUCT DISPLAY SYSTEM FOR DISPOSABLE ABSORBENT ARTICLE CONTAINERS HAVING ENHANCED VISIBILITY AND RECOGNITION

(75) Inventors: Jennifer Lynn Lowery, Blue Ash, OH (US); Kevin Michael Sams, San Francisco, CA (US); Danielle Lee Abel, Cincinnati, OH (US); Shanyn Krista Brady, Cincinnati, OH (US); Alfredo de Jesús Hidalgo, Cincinnati, OH (US); Paul Patrick Landers, Cincinnati, OH (US); Brenda Marie Mahan, Liberty Township, OH (US); Douglas John Whittle, Independence, KY (US)

(73) Assignee: The Procter & Gamble Company, Cincinnati, OH (US)

( * ) Notice: Subject to any disclaimer, the term of this patent is extended or adjusted under 35 U.S.C. 154(b) by 306 days.

(21) Appl. No.: 12/607,153

(22) Filed: Oct. 28, 2009

(65) Prior Publication Data

US 2011/0094979 A1 Apr. 28, 2011

(51) Int. Cl.

| | |
|---|---|
| ***B65D 85/00*** | (2006.01) |
| *B65D 65/00* | (2006.01) |
| *B65D 19/00* | (2006.01) |

(52) U.S. Cl.

USPC ..... 206/459.5; 206/429; 206/386

(58) Field of Classification Search

USPC ..... 211/49.1, 194, 191, 71.01; 108/57.17, 108/51.11; 206/386, 459.5, 597, 429

See application file for complete search history.

(56) References Cited

U.S. PATENT DOCUMENTS

| | | | | |
|---|---|---|---|---|
| 515,668 | A * | 2/1894 | Ferres | 229/90 |
| 1,958,231 | A * | 5/1934 | Bohlmann | 206/459.5 |
| 2,211,869 | A * | 8/1940 | Tobita | 206/459.5 |
| 2,843,260 | A * | 7/1958 | Sommer | 206/408 |
| 2,908,122 | A * | 10/1959 | Allen | 53/399 |
| 2,967,612 | A * | 1/1961 | Baumer | 206/322 |
| D217,574 | S * | 5/1970 | Couve | D19/5 |
| 4,270,657 | A * | 6/1981 | Bayon | 206/386 |
| 5,116,191 | A * | 5/1992 | Van | 414/802 |

(Continued)

FOREIGN PATENT DOCUMENTS

WO WO 2007/074412 A2 7/2007

OTHER PUBLICATIONS

International Search Report and Written Opinion, PCT/US2010/052146, mailed Dec. 9, 2010, 12 pages.

*Primary Examiner* — Joshua J Michener
*Assistant Examiner* — Devin Barnett
(74) *Attorney, Agent, or Firm* — Christian M. Best; Andrew A. Paul; John P. Colbert

(57) ABSTRACT

A product display system for disposable absorbent article containers is provided. The product display system includes a first stacked product array including a first set of individual disposable absorbent article containers and a second stacked product array including a second set of individual disposable absorbent article containers. Each individual disposable absorbent article container contains a first and second visible graphic such that when the individual containers are stacked appropriately the combination of visible graphics forms a continuous larger visible graphic. The set of stacked product arrays maintains the continuous larger visible graphic, even when some individual containers from the product display are removed or missing. A method for enhancing the visibility and recognition of a product display system is also provided.

25 Claims, 5 Drawing Sheets

(56) References Cited

U.S. PATENT DOCUMENTS

| | | | | |
|---|---|---|---|---|
| 5,337,681 | A * | 8/1994 | Schrage | 108/56.1 |
| 5,339,957 | A * | 8/1994 | Carstens | 206/386 |
| 5,895,540 | A * | 4/1999 | David et al. | 156/226 |
| 6,050,419 | A * | 4/2000 | Flanagan et al. | 206/597 |
| 6,405,921 | B1 | 6/2002 | Cochrane | |
| 6,520,330 | B1 * | 2/2003 | Batra | 206/494 |
| 7,017,748 | B2 * | 3/2006 | Weinstein | 206/534 |
| 2003/0234199 | A1 * | 12/2003 | Morita et al. | 206/459.5 |
| 2005/0092554 | A1 | 5/2005 | McGillin et al. | |
| 2007/0235263 | A1 * | 10/2007 | Legault et al. | 186/52 |
| 2007/0241016 | A1 * | 10/2007 | Piczon | 206/429 |
| 2008/0006552 | A1 * | 1/2008 | Vonderlack et al. | 206/386 |
| 2008/0006692 | A1 * | 1/2008 | Gillespie et al. | 235/381 |
| 2008/0105593 | A1 * | 5/2008 | Kleinsmith | 206/736 |
| 2009/0200070 | A1 * | 8/2009 | Kato et al. | 174/257 |
| 2011/0132788 | A1 * | 6/2011 | Middlesworth et al. | 206/459.5 |
| 2011/0139653 | A1 * | 6/2011 | Kleinsmith | 206/386 |

* cited by examiner

PRODUCT DISPLAY SYSTEM FOR DISPOSABLE ABSORBENT ARTICLE CONTAINERS HAVING ENHANCED VISIBILITY AND RECOGNITION

FIELD OF THE INVENTION

The present application relates generally to a product display system and method of displaying disposable absorbent article containers. The present application also relates to a product display system for facilitating consumers' identification and selection of the appropriate disposable absorbent article configuration for a particular wearer.

BACKGROUND OF THE INVENTION

Products such as disposable absorbent articles including diapers, pant style diapers, training pants, incontinence briefs, incontinence undergarments, absorbent inserts, diaper holders and liners, feminine hygiene garments, and the like are often contained in a variety of containers such as bags, boxes or cartons and stacked together as part of a store display. Typically, each container includes an identical graphic (i.e., artwork) thereupon which identifies the product, provides information to the consumer, and may also provide aesthetic benefits. However, in many stores, especially in, for example, warehouse/wholesale stores, supermarkets, and/or club stores such as Wal-Mart, Target, Kroger, B.J.'s, Sam's Club, Costco, etc., many thousands of products are displayed simultaneously, leading to low visibility for individual products. In these types of stores, it is also common to see large displays of products provided in a floor display. These displays provide numerous cartons or cases of products for purchase by consumers, and often include several shipping cartons stacked in a group. Sometimes, such displays are provided on a supporting medium, for example, a pallet.

Freestanding floor displays present problems for shoppers and store employees responsible for such displays. A problem for shoppers and retailers is that products provided on floor displays often become disorganized and unsightly due to the removal of products by other shoppers or the placement of additional items onto the display by shoppers who decide they no longer want to purchase the additional item. Another problem is that due to the popularity of floor displays in large warehouse/wholesale stores, it is becoming increasingly difficult and time consuming for shoppers to easily see, recognize and find the products they desire. This lack of visibility often results in a less than ideal experience for the shopper and lost sales for the retailer.

Various systems and methods for effectively organizing and displaying products and increasing visibility and recognition of products are known, such as using specially-designed display cases, separate signs hung above or from the products, shelf-stickers, televisions, etc. However, such systems and methods require additional materials other than the product themselves. Such systems and methods may also take up additional floor space and/or store volume which is essentially "dead-space" which can not be used to store or display actual products for sale, and thereby decreases floor utilization efficiency.

With respect to disposable absorbent article offerings, store displays may include an abundance of disposable absorbent article products. For example, many manufacturers offer several versions of disposable absorbent article products in different "tiers" or "levels". These could represent different sub-needs or different levels of technology with different corresponding price points. As a result, it can be confusing for consumers to select the proper product in terms of appropriate size/stage/features and an appropriate tier level and to navigate among the offerings for a desired product even if such basic information such as desired brand and size is known. In addition, consumers shopping for disposable absorbent article products often have babies or small children with them, resulting in less ability to intently focus upon the multiplicity of product offerings. As such, a consumer, given the overwhelming range of options, may select the wrong product (i.e., a product other than that intended) or a product which may not be optimum (i.e., wrong stage, wrong features, wrong size). Either could lead to a less than ideal use experience.

Accordingly, there remains a need for a product display system for disposable absorbent article containers, that both enhances the visibility and recognition of a floor display in a store and makes it easier for a consumer to select the correct product, while at the same time making it easier for the store to maintain the display in an organized and visually pleasant manner.

SUMMARY OF THE INVENTION

In one embodiment, a product display system for disposable absorbent article containers having enhanced visibility and recognition is provided. The product display system comprises a first stacked product array and a second stacked product array. The first stacked product array includes a first set of individual disposable absorbent article containers, each individual container having a top panel, a bottom panel, a front panel, two side panels, and a back panel, wherein the front panel includes a first visible graphic having first and second endpoints, wherein the side panels each include a second visible graphic having first and second endpoints, such that when the first set of individual containers are arranged on the display system at least one endpoint of the first visible graphic of a first individual container front panel matches at least one endpoint of the first visible graphic of an immediately adjacent second individual container front panel, the combination of the first visible graphics forming a continuous larger visible graphic. The second stacked product array includes a second set of individual disposable absorbent article containers, each individual container in the second set of individual containers having a top panel, a bottom panel, a front panel, two side panels, and a back panel, wherein the front panel includes the same first visible graphic as the first set of individual containers and the side panels each include the same second visible graphic as the first set of individual containers. The first stacked product array is positioned relative to the second product array such that the back panel of an individual container from the first stacked product array abuts the front panel of an individual container from the second stacked product array, wherein if an individual container is removed from the first stacked product array, the larger visible graphic remains continuous.

In another embodiment, a method of displaying disposable absorbent article containers is provided. The method includes placing a product display system at a display area in a store. The product display system comprises a first stacked product array and a second stacked product array. The first stacked product array includes a first set of individual disposable absorbent article containers, each individual container having a top panel, a bottom panel, a front panel, two side panels, and a back panel, wherein the front panel includes a first visible graphic having first and second endpoints, wherein the side panels each include a second visible graphic having first and second endpoints, such that when the first set of individual containers are arranged on the display system at least one endpoint of the first visible graphic of a first individual container front panel matches at least one endpoint of the first visible graphic of an immediately adjacent second individual container front panel, the combination of the first visible graphics forming a continuous larger visible graphic. The second stacked product array includes a second set of individual disposable absorbent article containers, each individual container in the second set of individual containers having a top panel, a bottom panel, a front panel, two side panels, and a back panel, wherein the front panel includes the same first visible graphic as the first set of individual containers and the side panels each include the same second visible graphic as the first set of individual containers. The first stacked product array is positioned relative to the second product array such that the back panel of an individual container from the first stacked product array abuts the front panel of an individual container from the second stacked product array, wherein if an individual container is removed from the first stacked product array, the larger visible graphic remains continuous.

It has now been found that since the stacked product arrays form a continuous larger visible graphic regardless of whether or not individual containers have been removed, the visibility and recognition of the array of disposable absorbent article containers is significantly increased. Such an improved stacked product array also helps a consumer recognize the product container from farther away and also to more quickly "cut through the visual clutter" in the store, in order to find a desired product in a crowded warehouse/wholesale store, supermarket, or club store.

BRIEF DESCRIPTION OF THE DRAWINGS

While the specification concludes with claims which particularly point out and distinctly claim the invention, it is believed the various embodiments will be better understood from the following description taken in conjunction with the accompanying drawings, in which:

The figures herein are not necessarily drawn to scale.

DETAILED DESCRIPTION OF THE INVENTION

As used herein, the term "absorbent article" refers to devices which are designed to absorb and contain bodily exudates, and, more specifically, refers to devices which are placed within, against, or in proximity to, the body of the wearer to absorb and contain the various exudates discharged from the body.

As used herein, the term "diaper" refers to an absorbent article generally used by infants and incontinent persons that is worn about the lower torso of the wearer.

As used herein, the term "disposable" describes absorbent articles which are generally not intended to be laundered or otherwise restored or reused as an absorbent article (in other words, they are generally intended to be discarded after a single use, and, preferably, to be disposed of in an environmentally compatible manner).

Figure 1:
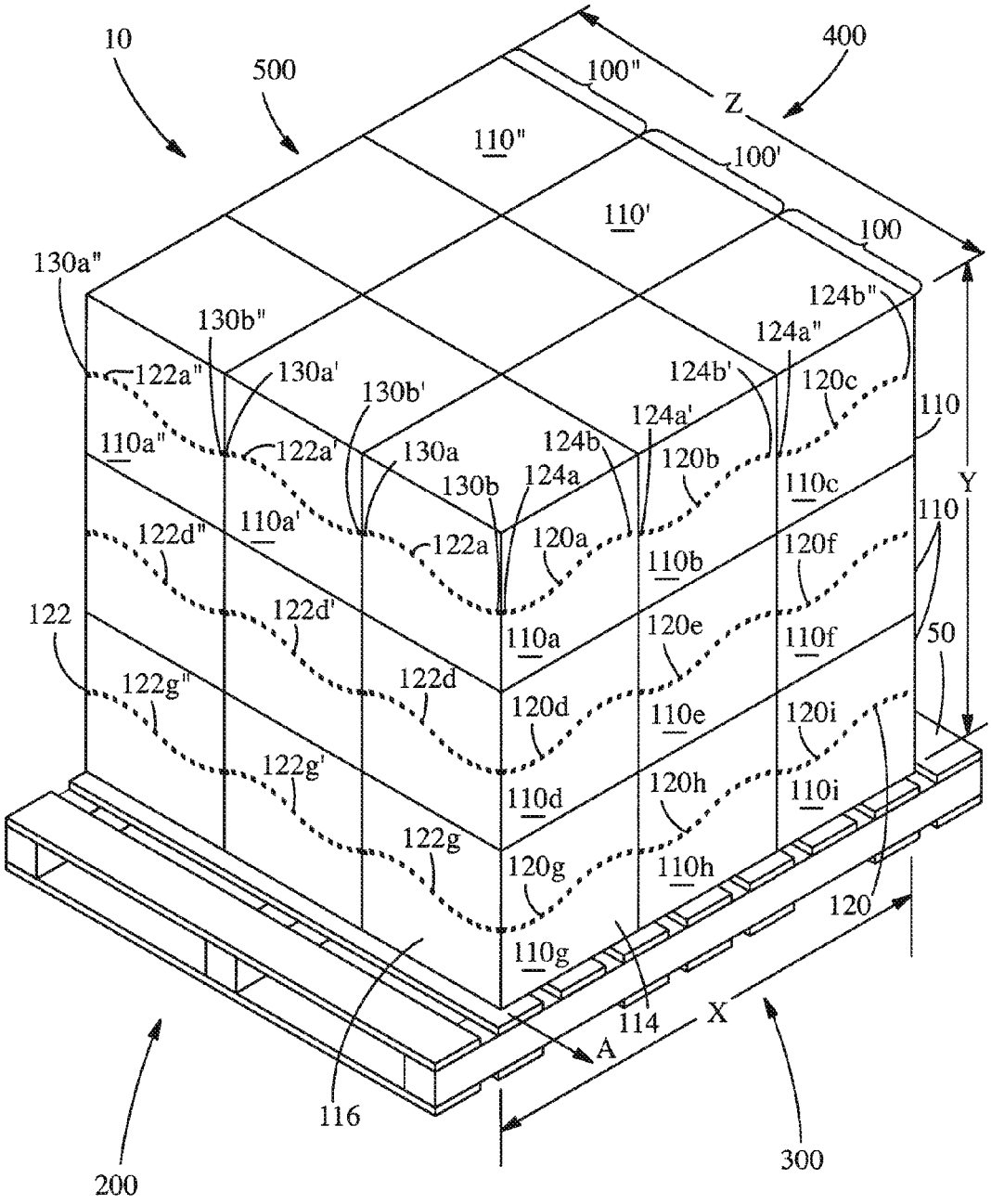
FIG. 1 illustrates an exemplary product display system for disposable absorbent article containers in accordance with one embodiment.

As used herein with respect to any specific stacked product array, the terms "deep" and "deeper" indicates farther away from a viewer (see point A in FIG. 1) who is facing the continuous larger visible graphic, i.e., as per the Z dimension in FIG. 1.

As used herein, the term "matches" and various forms thereof such as "matching" mean that when an endpoint of a visible graphic is correctly aligned with the corresponding endpoint of another visible graphic, the patterns, colors, lines, and/or visual elements of each of the visible graphics together form what appears to be a larger continuous graphic.

As used herein, the terms "stack appropriately" and "stacked appropriately" indicates that the individual containers with their visible graphics are aligned and stacked, at least initially, in a manner consistent with forming, and so as to form, the desired continuous larger visible graphic.

As used herein, with respect to any specific stacked product array, the term "tall" indicates up-and-down from the point of view of a viewer (see point A in FIG. 1) who is facing the continuous larger visible graphic, i.e., as per the Y dimension in FIG. 1.

As used herein with respect to any specific stacked product array, the term "wide" indicates from left-to-right from the point of view of a viewer (see point A in FIG. 1) who is facing the continuous larger visible graphic, i.e., as per the X dimension in FIG. 1.

Stacked product arrays are common in large stores, especially at the ends of rows, near a checkout location, near the entrance and/or exit doors, in the aisles and open areas or any other suitable location where they are intended to draw attention. Such displays are also often used for special promotions or sales. However, with the growth in floor space of the larger stores combined with the proliferation of such stacked products, it can be increasingly difficult to rapidly recognize and identify specific desired products. Previously, problems such as a lack of visibility were addressed by preparing special advertising materials and in-store materials such as hanging flags, special display cases, and even placing television screens to attract and hold the attention of customers. However, such methods may be expensive and add extra expense over and beyond the price of the individual products themselves. Such use of additional in-store materials can also reduce the profitability of each square meter of floor space as costs tend to increase, and as floor space is taken up with non-saleable goods. Thus, dead-space is decreased, and existing floor space may be used more efficiently and profitably.

In one embodiment, the present disclosure provides a way of using the actual individual disposable absorbent article containers to be sold as a larger advertising medium by forming a continuous larger visible graphic, and thereby reducing or eliminating the need for additional in-store promotion materials. Especially in a typical large warehouse store, such a continuous larger visible graphic may be more easily seen from a distance whereas multiple smaller graphics would be lost in the visual clutter of the store. The disposable absorbent articles can be packaged in a variety of containers such as bags, boxes or cartons and stacked together as part of a store display. In one embodiment, as shown in FIG. 1, the absorbent articles are packaged in a box.

Accordingly, the present disclosure provides a stacked product array having enhanced visibility and recognition which contains a plurality of individual disposable absorbent article containers, each individual disposable absorbent article container comprising a visible graphic. When the individual disposable absorbent article containers are aligned together at least one edge of each visible graphic matches at least one edge of at least one other visible graphic. In contrast to typical in-market product containers, when the individual disposable absorbent article containers are stacked appropriately the combination of the visible graphics forms a continuous larger visible graphic.

Turning to the figures, FIG. 1 shows a product display system 10 having a top, a bottom (not shown), a front 300, two sides 200, 400 and a back 500. In one embodiment, the product display system 10 includes a stacked product array 100 of individual disposable absorbent article containers stacked appropriately. The stacked product array 100 contains a plurality of individual disposable absorbent article product containers 110 arranged on a supporting medium. For example, stacked product array 100 contains individual disposable absorbent article containers 110*a*, 110*b*, 110*c*, 110*d*, 110*e*, 110*f*, 110*g*, 110*h*, and 110*i* arranged on pallet 50. The stacked array of disposable absorbent articles described herein may be applicable to a number of absorbent article products, such as diapers, training pants, adult incontinence products, feminine hygiene garments, facial tissues, bathroom tissues, paper towels and paper napkins. In another embodiment, the contents of the individual container may be selected from, for example, a laundry or other type of detergents, fabric softeners, bleaches, fabric pretreaters and dryer sheets. In another embodiment, the contents of the individual container may be selected from, for example, dishwashing detergents, glass cleaners, hard surface cleaners, fabric deodorizers, air fresheners, and hard surface sanitizers. In another embodiment, the contents of the individual container may be selected from, for example, cosmetics, gift packs, electric or manual appliances, razors, hair products, skin products, pet food products, a consumable product such as food, etc.

Each individual disposable absorbent article container 110, is removably stacked within the stacked product array 100 such that it can be repeatedly removed and replaced with the same individual disposable absorbent article container, or another. As shown in FIG. 1, the individual disposable absorbent article containers 110 are aligned in a first stacked product array 100 which is three individual containers wide and three individual containers tall. In the first stacked product array 100 each individual disposable absorbent article container 110 has a first visible graphic 120 and a second visible graphic 122. In one embodiment, individual disposable absorbent article container 110*a* has a first visible graphic 120*a*. Similarly, individual container 110*b* has a first visible graphic 120*b*, individual container 110*c* has a first visible graphic 120*c*, individual container 110*d* has a first visible graphic 120*d*, individual container 110*e* has a first visible graphic 120*e*, individual container 110*f* has a first visible graphic 120*f*, individual container 110*g* has a first visible graphic 120*g*, individual container 110*h* has a first visible graphic 120*h*, and individual container 110*i* has a first visible graphic 120*i*. In one embodiment, first visible graphic 120 is identical on each individual container 110 stacked within array 100. In another embodiment, second visible graphic 122 is identical on each individual container 110 stacked within array 100. In another embodiment, the first visible graphic 120 and the second visible graphic 122 are identical. In yet another embodiment, the first visible graphic 120 and the second visible graphic 122 are different.

Figure 2A:
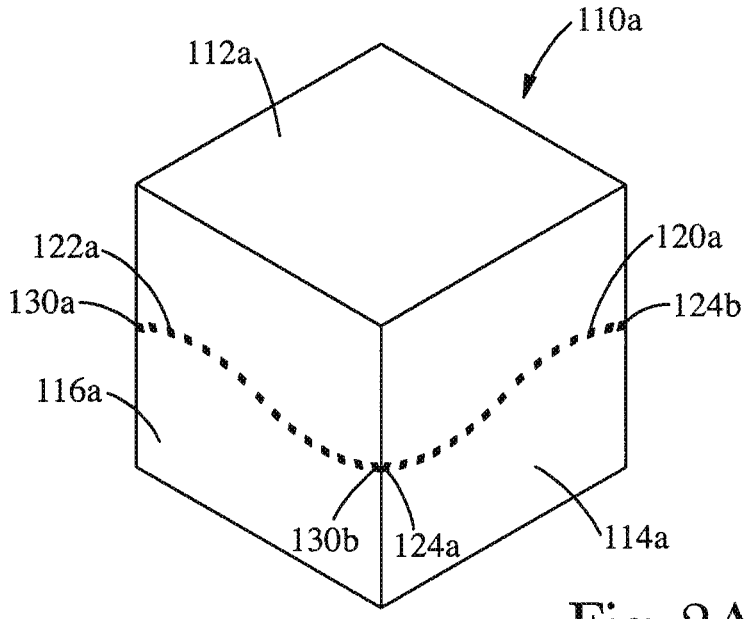
FIG. 2*a* illustrates an exemplary individual disposable absorbent article container from the product display system shown in FIG. 1.
Figure 2B:
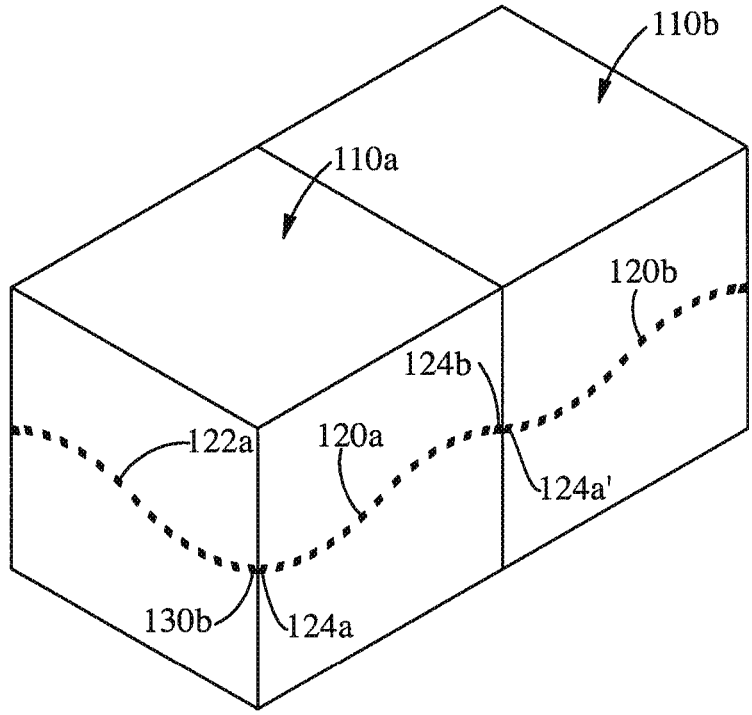
FIG. 2*b* illustrates two adjacent exemplary disposable absorbent article containers from the product display system shown in FIG. 1.
Figure 5:
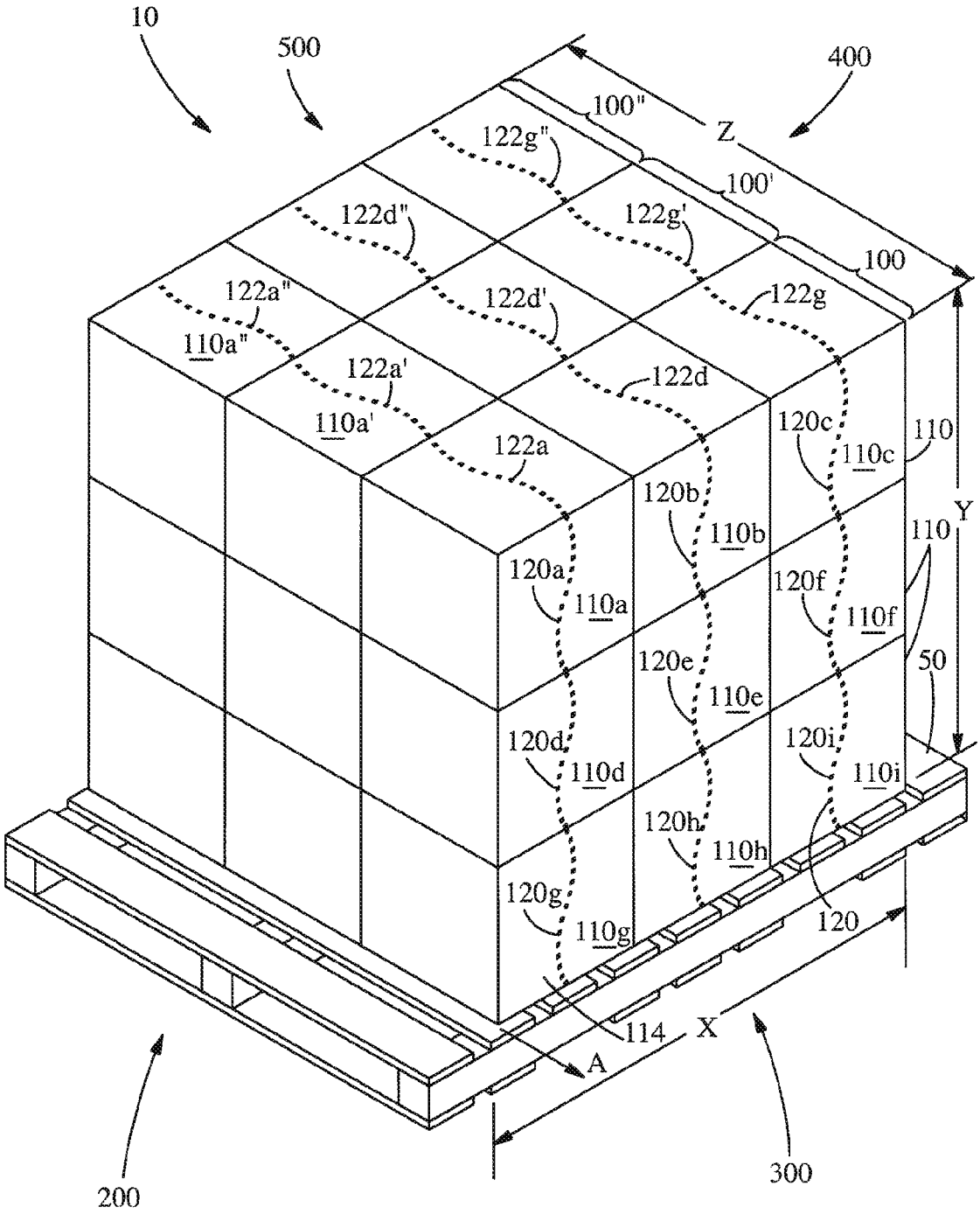
FIG. 5 illustrates an exemplary product display system for disposable absorbent article containers in accordance with another embodiment.

When looking at the array from the perspective of point A in FIG. 1 and further shown in FIG. 2, each individual disposable absorbent article container, for example 110*a*, also has a top panel 112, a bottom panel (not shown), a front panel 114, two side panels 116 (only one side panel is shown) and a back panel (not shown). As further shown in FIG. 2, front panel 114*a* of individual container 110*a* includes first visible graphic 120*a* and side panel 116*a* includes second visible graphic 122*a*. The first visible graphic 120*a* has first and second endpoints 124*a* and 124*b* (located on the left and right edges of front panel 114*a* of individual container 110*a*, respectively) and the second visible graphic 122*a* has first and second endpoints 130*a* and 130*b* (located on the left and right edges of side panel 116*a* of individual container 110*a*, respectively). This results in first visible graphic 120*a* appearing crosswise on container 110*a* as shown in FIG. 1. In another embodiment, first and second endpoints 124*a* and 124*b* of first visible graphic 120*a* are located on the top and bottom edges of front panel 114*a* and first and second endpoints 130*a* and 130*b* of second visible graphic 122*a* are located on the top and bottom edges of top panel 112*a*. This results in first visible graphic 120*a* appearing lengthwise on container 110*a* as shown in FIG. 5. In yet another embodiment, first and second endpoints 124*a* and 124*b* of first visible graphic 120*a* are located on opposing corners of front panel 114*a* and first and second endpoints 130*a* and 130*b* of second visible graphic 122*a* are located on opposing corners of side panel 116*a*. This results in first visible graphic 120*a* appearing diagonally on container 110*a*.

In one embodiment, as shown in FIG. 1, visible graphic 120*a* has endpoints 124*a* and 124*b*, visible graphic 120*b* has endpoints 124*a*' and 124*b*' and visible graphic 120*c* has endpoints 124*a*" and 124*b*". The endpoint 124*b* of visible graphic 120*a* matches the endpoint 124*a*' of visible graphic 120*b* and the endpoint 124*a*" of visible graphic 120*c* matches the endpoint 124*b*' of visible graphic 120*b*. As shown in FIG. 1, the endpoints of visible graphics 120*a*, 120*b* and 120*c* match to form a continuous larger visible graphic across three individual containers within array 100. In an embodiment herein, each visible graphic 120 has at least one endpoint 124 which matches at least one endpoint of an immediately adjacent visible graphic 120.

As further shown in FIG. 1, individual container 110*a*' includes second visible graphic 122*a*' and individual container 110*a*" includes second visible graphic 122*a*". Second visible graphic 122*a*' has first and second endpoint 130*a*' and 130*b*' and second visible graphic 122*a*" has first and second endpoints 130*a*" and 130*b*". In one embodiment, endpoint 130*b* of second visible graphic 122*a* matches endpoint 124*a* of first visible graphic 120*a*. In addition, endpoint 130*a* of second visible graphic 122*a* matches endpoint 130*b*' of second visible graphic 122*a*' and endpoint 130*a*' of second visible graphic 122*a*' matches endpoint 130*b*" of second visible graphic 122*a*". As shown in FIG. 1, the endpoints of second visible graphics 122*a*, 122*a*', and 122*a*" match to form a continuous larger visible graphic across individual containers 110*a*, 110*a*' and 110*a*". The visible graphics herein may be attached to the individual containers by any manner known in the art, such as printing, etching, laminating, gluing/adhesives, silk-screening, etc. In an embodiment herein, the visible graphic is formed as part of the individual product's container or package.

In the embodiment of FIG. 1, first visible graphics 120*a*, 120*b*, and 120*c* match to form a continuous larger visible graphic crosswise array 100, which promotes recognition of the individual container. Similarly, first visible graphics 120*d*, 120*e* and 120*f* match to form a continuous larger visible graphic crosswise array 100. As further shown in FIG. 1, first visible graphics 120*g*, 120*h* and 120*i* match to form a continuous larger visible graphic crosswise array 100. In another embodiment, the first visible graphics may be arranged to match to form a continuous larger visible graphic lengthwise on array 100. In another embodiment, the first visible graphics may be arranged to match to form a continuous larger visible graphic diagonally across array 100.

According to one embodiment, as shown in FIG. 1, second visible graphics 122*a*, 122*a*', and 122*a*" match to form a continuous larger visible graphic crosswise arrays 100, 100' and 100". Similarly, second visible graphics 122*d*, 122*d*' and 122*d*" match to form a continuous larger visible graphic crosswise arrays 100, 100' and 100". As further shown in FIG. 1, second visible graphics 122*g*, 122*g*' and 122*g*" match to form a continuous larger visible graphic crosswise arrays 100, 100' and 100". In another embodiment, the second visible graphics may be arranged to match to form a continuous larger visible graphic lengthwise array 100. In another embodiment, the second visible graphics may be arranged to match to form a continuous larger visible graphic diagonally across arrays 100, 100' and 100".

As a result of this stacked arrangement, when the product display system 10 of FIG. 1 is placed on display in a store, the continuous larger visible graphic formed by first visible graphics 120*a*, 120*b* and 120*c* match the continuous larger visible graphic formed by second visible graphics 122*a*, 122*a*', and 122*a*" such that the repetitive visible graphic wraps itself around the stacked product array, i.e., from front 300 to side 200. Similarly, the continuous larger visible graphic formed by first visible graphics 120*d*, 120*e* and 120*f* match the continuous larger visible graphic formed by second visible graphics 122*d*, 122*d*', and 122*d*"; and the continuous larger visible graphic formed by first visible graphics 120*g*, 120*h* and 120*i* match the continuous larger visible graphic formed by second visible graphics 122*g*, 122*g*', and 122*g*".

Figure 3:
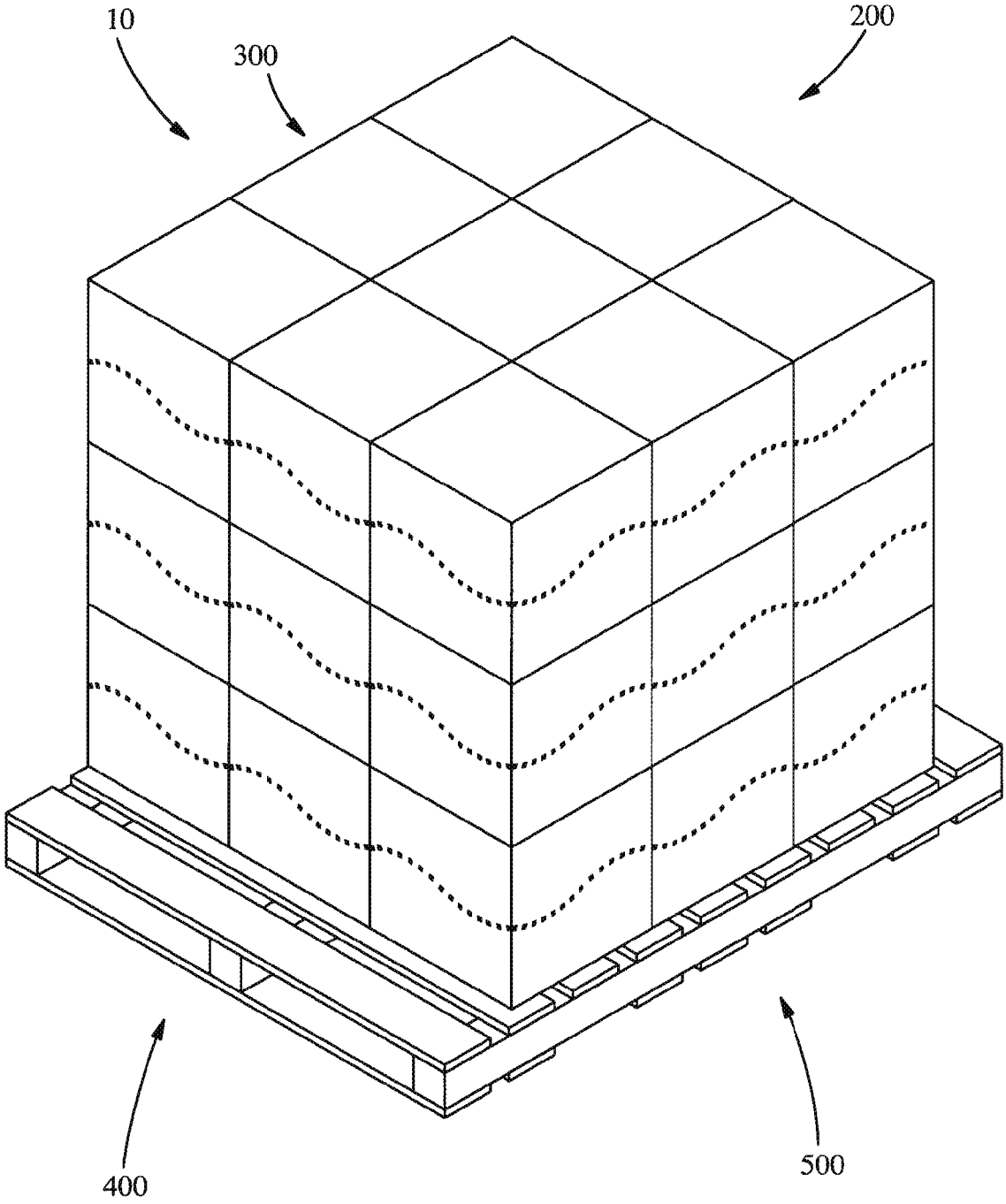
FIG. 3 illustrates an exemplary product display system for disposable absorbent article containers as shown in FIG. 1, with the system rotated 180 degrees as compared to the system shown in FIG. 1.

Referring to FIG. 3, the product display system as shown in FIG. 1 is rotated 180 degrees to illustrate that the visible graphics also appear on side 400 and back 500. Specifically, in one embodiment, the visible graphics on front 300 of FIG. 1 are identical to the visible graphics on face 500 of FIG. 2. And the visible graphics on side 200 of FIG. 1 are identical to the visible graphics on side 400 of FIG. 2. As a result, the continuous larger visible graphics discussed above with respect to the embodiment of FIG. 1 are also formed on back 500 and side 400 of FIG. 2. This allows the continuous larger visible graphics to be visible to the consumer regardless of where the consumer is standing in relation to the display system.

In the embodiment of FIG. 1, each visible graphic, 120, is represented by a segmented line, formed by alternating square shapes. The segmented line may also be formed by alternating circles, rectangles, triangles or any other suitable shape. In another embodiment, the alternating shapes can be of the same color or a set of repeating colors to draw consumers' attention to the display system. In another embodiment, the visible graphic may be a solid line. It is recognized that depending on the actual embodiment, the size and shape of each visible graphic may vary widely. It is also recognized that the continuous larger visible graphic may form a picture, a trademark, a logo, etc. which promotes recognition of the individual container, or in many cases the continuous larger visible graphic may contain therein a picture, a trademark, a logo, etc. which promotes recognition of the individual container.

In FIG. 1, the individual containers are in the form of boxes, however other container forms and shapes are also useful herein. The individual containers in the Figures contain rectangular or square cross-sections, but other shaped cross-sections are also contemplated and included herein. Containers may be made with materials known in the packaging art such as paper, cardboard, plastics, resins, laminates, films, metal, wood, glass, etc., and by processes known in the packaging art. In an embodiment herein the shape of each individual container is substantially identical, as such shapes may be easier to stack appropriately to form the continuous larger visible graphic, may be more stable upon stacking, and/or may fit together better, either structurally, or so as to form the continuous larger visible graphic. In an embodiment herein the dimensions of each individual container are substantially identical, as such shapes may be easier to stack appropriately to form the continuous larger visible graphic, may be more stable upon stacking, and/or may fit together better. In an embodiment herein, the individual containers are in the form of boxes which are easy to stack appropriately and which are relatively stable once stacked. Such boxes may be cubes, or boxes with two or more rectangular sides. In an embodiment herein the boxes are cubes. In another embodiment herein, the boxes have four rectangular sides and two square sides.

Behind and immediately deeper than the first stacked product array in FIG. 1 is a second stacked product array, 100', also formed of a plurality of individual containers, 110', stacked three individual containers wide and three individual containers tall. The term "immediately deeper" means that first stacked product array is positioned relative to the second product array such that the back panel of an individual container from the first stacked product array abuts the front panel of an individual container from the second stacked product array. Similarly, behind and immediately deeper than the second stacked product array 100' is a third stacked product array, 100", also formed of a plurality of individual containers, 110", stacked three individual containers wide and three individual containers tall.

The second continuous larger visible graphic of the second stacked product array, 100' is not visible in FIG. 1, as it is hidden by the first stacked product array, 100. Similarly, the third continuous larger visible graphic of the third stacked product array 100" is not visible in FIG. 1, as it is hidden by the first and second stacked product arrays, 100 and 100', respectively. In one embodiment, a set of stacked product arrays contains a first stacked product array, a second stacked product array stacked immediately deeper than the first stacked product array, and a third stacked product array stacked immediately deeper than the second stacked product array, as shown in FIG. 1. Such a first stacked product array contains a first set of individual containers which form a continuous larger visible graphic which is designated as a first continuous larger visible graphic. The second stacked product array contains a second set of individual containers, identical to those of the first stacked product array. As shown in FIG. 1, the second stacked product array is stacked immediately deeper than the first stacked product array, such that the second set of individual containers are stacked immediately deeper than the first set of individual containers. The second set of individual containers contains the same visible graphic as a corresponding individual container from the first set of individual containers.

As used herein, a "corresponding individual container" in a first set of individual containers indicates that when a viewer is facing and looking at the continuous larger visible graphic, the corresponding individual container is closer to the viewer and blocking the individual container in the second set of individual containers from being viewed. For example, in FIG. 1, when seen from the eye at point A, the individual container 110*a*' has the same first and second visible graphics as individual container 110*a*, even though individual container 110*a*' is currently blocked by individual container 110*a*. As further shown in FIG. 1, the third stacked product array is stacked immediately deeper than the second stacked product array, such that the third set of individual containers are stacked immediately deeper than the second set of individual containers. The third set of individual containers contains the same first and second visible graphics as a corresponding individual container from the second set of individual containers.

Figure 4:
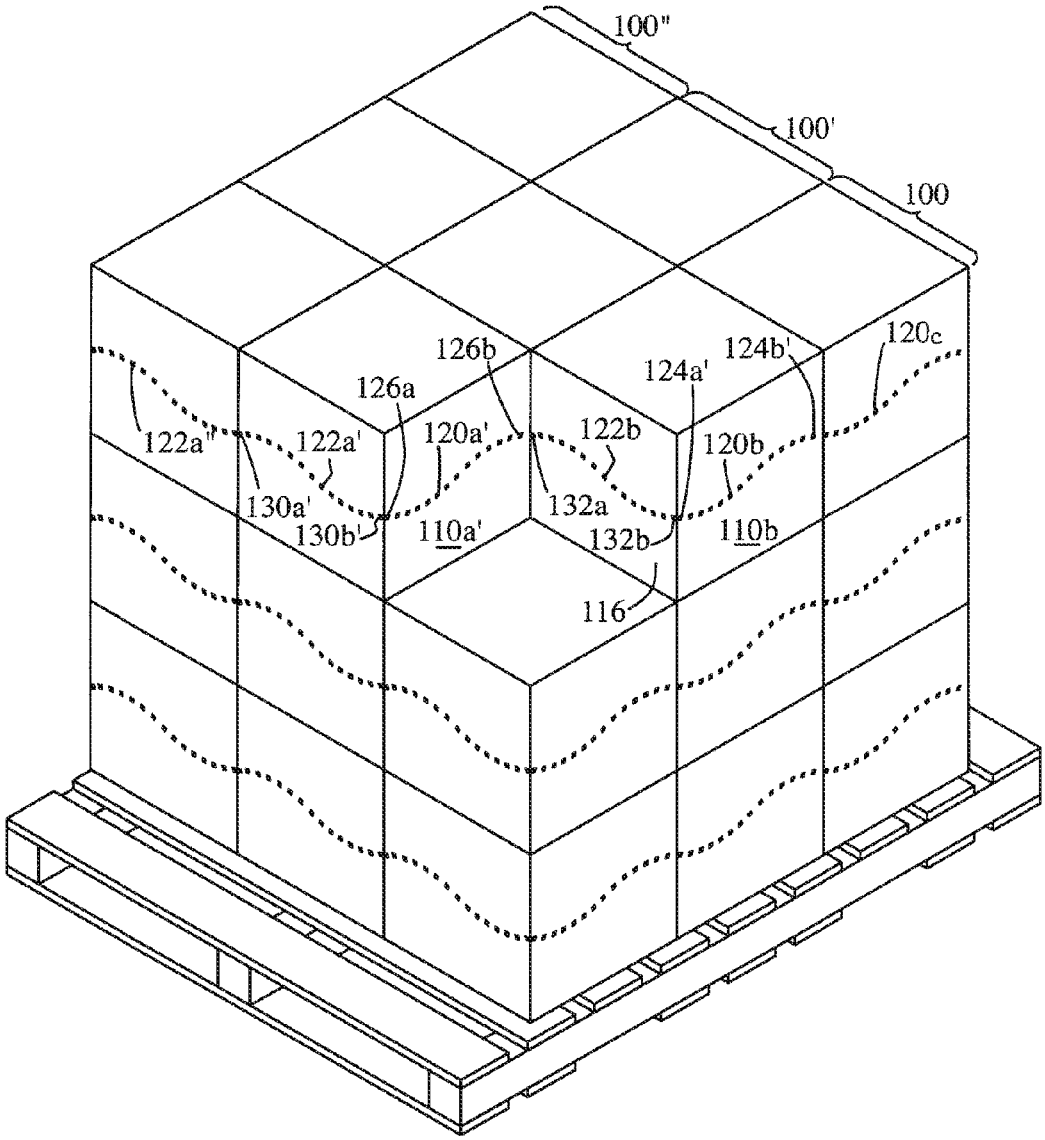
FIG. 4 illustrates an exemplary product display system for disposable absorbent article containers as shown in FIG. 1, with an individual container removed.

In another embodiment as shown in FIG. 4, individual container 110*a* is removed from the product display system. Thus, when individual container 110*a* is removed from the stacked product array, 100, the first visible graphic 120*a*' from individual container 110*a*', from the second set of individual containers (in the second stacked product array) is now visible. As further shown in FIG. 4, individual container 110*b* from the first stacked product array contains second visible graphic 122*b* located on side panel 116. In one embodiment, first visible graphic 120*b* has first and second endpoints 124*a*' and 124*b*'; second visible graphic 122*b* has first and second endpoints 132*a* and 132*b*; and first visible graphic 120*a*' has first and second endpoints 126*a* and 126*b*.

In the embodiment shown in FIG. 4, endpoint 124*a*' of first visible graphic 120*b* matches endpoint 132*b* of second visible graphic 122*b*; endpoint 132*a* of second visible graphic 122*b* matches endpoint 126*b* of first visible graphic 120*a*'; and endpoint 126*a* of first visible graphic 120*a*' matches endpoint 130*b*' of second visible graphic 122*a*'. Thus, when individual container 110*a* is removed from the stacked product array, 100, the continuous larger visible graphic previously formed by first visible graphics 120*a*, 120*b* and 120*c* and second visible graphics 122*a*, 122*a*', and 122*a*", as shown in FIG. 1, remains continuous and is formed by visible graphics 120*c*, 120*b*, 122*b*, 120*a*', 122*a*' and 122*a*". Such a set of stacked product arrays allows the continuous larger visible graphic to be seen, even when individual containers from product display 10 are removed or missing.

In the embodiment of FIG. 1, each individual container 110, further contains additional visible graphics, which are identical on each individual container, 110. Such additional graphics are not intended to interact with each other but rather are intended to further enhance the recognition of the individual container when it is viewed outside of the context of the stacked product array, for example, when brought home for actual use. In an embodiment herein, the additional visible graphics include illustrations, paintings, photographs, drawings, pictures, logos, holograms, characters, cartoons, icons, sustainability icons, functional performance indicators, size indicators, count indicators, and promotional icons.

FIG. 5 shows a stacked product array 100, of individual containers 110, according to the present disclosure stacked appropriately. The stacked product array is three individual containers wide, and three individual containers tall. In this stacked product array, 100, the first and second visible graphics may be arranged to match to form a continuous larger visible graphic lengthwise array 100.

In an embodiment herein, the set of stacked product arrays contains three stacked product arrays. In another embodiment herein, the set of stacked product arrays contains from about 2 to about 9 stacked product arrays. In one embodiment, each stacked product array is from about 2 to about 6 individual containers wide, from about 2 to about 6 individual containers deep and from about 2 to about 6 individual containers tall. Without intending to be limited by theory, it has been found that increasing both the height and width can significantly enhance visibility and recognition of a container in a store-like environment, as compared to merely increasing height or width, alone.

According to the embodiments described herein, a stacked product array may be stacked appropriately by hand, by a machine during the production process, etc. In an embodiment herein, the stacked product array is stacked appropriately in a shipping container, such as a cardboard box or a shrink-wrapped film, formed around the array which is appropriately sealed and shipped to the store. The shipping container serves multiple purposes, such as protection of the individual products during shipping and handling, assuring that the stacked product array stays stacked appropriately, etc. Upon arrival in the store, a store employee or other individual removes at least a portion of the shipping container (i.e., by removing one or more side panels of the cardboard box or cutting away the shrink-wrap) to reveal the continuous larger visible graphic. Such an embodiment is especially advantageous as it significantly reduces work in the store to set up the stacked product array. In an embodiment herein, a stacked product array is further stacked on top of at least one other stacked product array so as to more efficiently use the floor space and also increase the visibility of the stacked product arrays from a distance. While the embodiments in the Figures all show rectangular or square stacked product arrays, other shapes and configurations are also specifically encompassed herein, such as, for example, pyramids, globes, circles, triangles, etc. Furthermore, it is recognized that the continuous larger visible graphic herein need not be in the same vertical or horizontal plane, and thus such a continuous larger visible graphic is specifically encompassed herein.

In an embodiment herein, the individual containers are boxes which contain multiple absorbent articles therein.

EXAMPLE 1

A first stacked product array according to FIG. 1 is formed by providing 27 individual containers in the form of boxes. Each box is of substantially identical dimensions and hold from about 40 to about 100 disposable diapers. Each individual container contains a visible graphic containing two endpoints which match with the corresponding endpoints of two adjacent individual containers as described above with respect to FIG. 1. The front, back and side panels of the product display system each contain at least one continuous larger visible graphic.

A manufacturing line assures that the individual containers are stacked appropriately such that the combination of the visible graphics forms a continuous larger visible graphic of the segmented line. A second stacked product array is then provided and stacked immediately deeper to the first stacked product array, and a third stacked product array is provided and stacked immediately deeper to the second stacked product array. The manufacturing line then forms a cardboard box shipping container around the set of three stacked product arrays. The shipping container contains easy-tear perforations and tape around the base to allow someone to easily remove the side panels to display the continuous larger visible graphic without having to separately take each individual box out of the shipping container and re-stack them appropriately.

The shipping container containing the three stacked product arrays is then shipped via standard transportation to a warehouse store for display and sale.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A product display system for disposable absorbent article containers having enhanced visibility and recognition comprising:

a first stacked product array including a first set of individual disposable absorbent article containers, each individual container having a top panel, a bottom panel, a front panel, two side panels, and a back panel, wherein the front panel includes a first visible graphic having first and second endpoints and the first visible graphic is identical on each individual container stacked within the first array, wherein the side panels each include a second visible graphic having first and second endpoints, such that when the first set of individual containers are arranged on the display system at least one endpoint of the first visible graphic of a first individual container front panel joins together with at least one endpoint of the first visible graphic of an immediately adjacent second individual container front panel, the combination of the first visible graphics forming a continuous larger visible graphic; and a second stacked product array including a second set of individual disposable absorbent article containers, each individual container in the second set of individual containers having a top panel, a bottom panel, a front panel, two side panels, and a back panel, wherein the front panel includes the same first visible graphic as the first set of individual containers, wherein the side panels each include the same second visible graphic as the first set of individual containers;

wherein the first stacked product array is positioned relative to the second product array such that the back panel of an individual container from the first stacked product array abuts the front panel of an individual container from the second stacked product array, wherein if an individual container is removed from the first stacked product array, the larger visible graphic remains continuous with one of the end points of the first or second visible graphics on each of two adjacent individual containers joined together.

2. The product display system according to claim 1, wherein the first and second stacked product arrays are at least two individual containers wide and at least two individual containers tall.

3. The product display system according to claim 1, wherein the dimensions of each individual container are substantially identical.

4. The product display system according to claim 1, wherein each individual container is removably stacked.

5. The product display system according to claim 1, wherein the first and second visible graphics are different.

6. The product display system according to claim 1, wherein the first and second visible graphics are identical.

7. The product display system according to claim 1, wherein the individual containers are stacked on a supporting medium.

8. The product display system according to claim 7, wherein the supporting medium is a pallet.

9. The product display system according to claim 1, wherein the system is located in a warehouse store.

10. The product display system according to claim 1, wherein the first and second visible graphics extend crosswise on each individual container.

11. The product display system according to claim 1, wherein the first and second visible graphics extend lengthwise on each individual container.

12. A method of displaying disposable absorbent article containers comprising:

providing a product display system at a display area in a store, the product display system comprising:

a first stacked product array including a first set of individual disposable absorbent article containers, each individual container having a top panel, a bottom panel, a front panel, two side panels, and a back panel, wherein the front panel includes a first visible graphic having first and second endpoints and the first visible graphic is identical on each individual container stacked within the first array, wherein the side panels each include a second visible graphic having first and second endpoints, such that when the first set of individual containers are arranged on the display system at least one endpoint of the first visible graphic of a first individual product front panel joins together with at least one endpoint of the first visible graphic of an immediately adjacent second individual container front panel, the combination of the first visible graphics forming a continuous larger visible graphic; and a second stacked product array including a second set of individual disposable absorbent article containers, each individual container in the second set of individual containers having a top panel, a bottom panel, a front panel, two side panels, and a back panel, wherein the front panel includes the same first visible graphic as the first set of individual containers, wherein the side panels each include the same second visible graphic as the first set of individual containers;

wherein the first stacked product array is positioned relative to the second product array such that the back panel of an individual container from the first stacked product array abuts the front panel of an individual container from the second stacked product array, wherein if an individual container is removed from the first stacked product array, the larger visible graphic remains continuous with one of the end points of the first or second visible graphics on each of two adjacent individual containers joined together.

13. The method according to claim 12, wherein the first and second stacked product arrays are at least two individual containers wide and at least two individual containers tall.

14. The method according to claim 12, wherein the dimensions of each individual container are substantially identical.

15. The method according to claim 12, wherein each individual container is removably stacked.

16. The method according to claim 12, wherein the first and second visible graphics are different.

17. The method according to claim 12, wherein the first and second visible graphics are identical.

18. The method according to claim 12, wherein the first and second visible graphics extend crosswise on each individual container.

19. The method according to claim 12, wherein the first and second visible graphics extend lengthwise on each individual container.

20. The product display system according to claim 1, wherein the second visible graphic is identical on each individual container stacked within the second array.

21. The method according to claim 12, wherein the second visible graphic is identical on each individual container stacked within the second array.

22. The product display system according to claim 1, wherein the absorbent article is selected from the group consisting of diapers, training pants, adult incontinence products, feminine hygiene garments, facial tissues, bathroom tissues, paper towels and paper napkins.

23. The method according to claim 12, wherein the absorbent article is selected from the group consisting of diapers, training pants, adult incontinence products, feminine hygiene garments, facial tissues, bathroom tissues, paper towels and paper napkins.

24. A product display system for skin care product containers having enhanced visibility and recognition comprising:

a first stacked product array including a first set of individual skin care product containers, each individual container having a top panel, a bottom panel, a front panel, two side panels, and a back panel, wherein the front panel includes a first visible graphic having first and second endpoints and the first visible graphic is identical on each individual container stacked within the first array, wherein the side panels each include a second visible graphic having first and second endpoints, such that when the first set of individual containers are arranged on the display system at least one endpoint of the first visible graphic of a first individual container front panel joins together with at least one endpoint of the first visible graphic of an immediately adjacent second individual container front panel, the combination of the first visible graphics forming a continuous larger visible graphic; and a second stacked product array including a second set of individual skin care product containers, each individual container in the second set of individual containers having a top panel, a bottom panel, a front panel, two side panels, and a back panel, wherein the front panel includes the same first visible graphic as the first set of individual containers, wherein the side panels each include the same second visible graphic as the first set of individual containers;

wherein the first stacked product array is positioned relative to the second product array such that the back panel of an individual container from the first stacked product array abuts the front panel of an individual container from the second stacked product array, wherein if an individual container is removed from the first stacked product array, the larger visible graphic remains continuous with one of the end points of the first or second visible graphics on each of two adjacent individual containers joined together.

25. A method of displaying skin care product containers comprising:

providing a product display system at a display area in a store, the product display system comprising:

a first stacked product array including a first set of individual skin care product containers, each individual container having a top panel, a bottom panel, a front panel, two side panels, and a back panel, wherein the front panel includes a first visible graphic having first and second endpoints and the first visible graphic is identical on each individual container stacked within the first array, wherein the side panels each include a second visible graphic having first and second endpoints, such that when the first set of individual containers are arranged on the display system at least one endpoint of the first visible graphic of a first individual product front panel joins together with at least one endpoint of the first visible graphic of an immediately adjacent second individual container front panel, the combination of the first visible graphics forming a continuous larger visible graphic; and a second stacked product array including a second set of individual skin care product containers, each individual container in the second set of individual containers having a top panel, a bottom panel, a front panel, two side panels, and a back panel, wherein the front panel includes the same first visible graphic as the first set of individual containers, wherein the side panels each include the same second visible graphic as the first set of individual containers;

wherein the first stacked product array is positioned relative to the second product array such that the back panel of an individual container from the first stacked product array abuts the front panel of an individual container from the second stacked product array, wherein if an individual container is removed from the first stacked product array, the larger visible graphic remains continuous with one of the end points of the first or second visible graphics on each of two adjacent individual containers joined together.

* * * * *